United States Patent [19]

Pepi et al.

[11] Patent Number: 4,901,799

[45] Date of Patent: Feb. 20, 1990

[54] SPRINKLER HEAD HAVING PROTUBERANT RIDGE VALVE SEAT

[75] Inventors: Jerome S. Pepi, North Attleboro, Mass.; James M. Martin, East Greenwich, R.I.

[73] Assignee: Grinnell Corporation, Exeter, N.H.

[21] Appl. No.: 210,827

[22] Filed: Jun. 24, 1988

[51] Int. Cl.[4] ..... A62C 37/08

[52] U.S. Cl. ..... 169/39; 169/37; 169/90; 169/41; 169/40; 169/38

[58] Field of Search ..... 169/37, 38, 39, 40, 169/41, 90

[56] References Cited

U.S. PATENT DOCUMENTS

| | | | |
|---|---|---|---|
| 431,971 | 7/1890 | Grinnell . | |
| 431,972 | 7/1890 | Grinnell . | |
| 635,749 | 10/1899 | Cox . | |
| 891,279 | 6/1908 | Martin . | |
| 2,553,726 | 5/1951 | Rowley | 169/38 |
| 3,253,657 | 5/1966 | Job . | |
| 3,336,984 | 8/1967 | Macartney | 169/38 |
| 3,809,118 | 5/1974 | Harding . | |
| 4,167,974 | 9/1979 | Job . | |
| 4,570,720 | 2/1986 | Retzloff . | |
| 4,580,729 | 4/1986 | Pounder . | |
| 4,623,023 | 11/1986 | Retzloff . | |
| 4,664,392 | 5/1987 | Hatch | 29/280 |

FOREIGN PATENT DOCUMENTS

| | | | |
|---|---|---|---|
| 989699 | 5/1976 | Canada | 169/90 |
| 1018283 | 10/1957 | Fed. Rep. of Germany . | |
| 246481 | 5/1926 | United Kingdom . | |
| 333412 | 8/1930 | United Kingdom . | |
| 552810 | 4/1943 | United Kingdom . | |

OTHER PUBLICATIONS

Upright and Pendent Sprinklers; Model F980 Designer, Bulb Type, ½" Orifice; Product Specification TD524.

*Primary Examiner*—Sherman D. Basinger
*Assistant Examiner*—Anne Sartelle
*Attorney, Agent, or Firm*—Fish & Richardson

[57] ABSTRACT

The invention relates to a fire protection sprinkler head having a base constructed for connection to a source of fire retardant fluid under pressure, a throat in the base through which fire retardant fluid can flow, a valve seat defined by the base about the periphery of the throat, and a resiliently flexible valve disk disposed across the throat and impressed upon the valve seat in sealing engagement. The valve seat has an arcuate profile segment, with a protuberant ridge disposed about the periphery of the throat and adjacent thereto. The ridge, in the region of its crest, defines a valve seat surface. The valve seat further has a recessed surface segment disposed radially outwardly of the throat, and divergent from a plane of the crest of the protuberant ridge. The valve disk has a sealing surface which is impressed upon the valve seat surface in the region of the crest of the protuberant ridge in sealing engagement over an annular region inward of the peripheral edge of the valve disk and in a manner to minimize the radial width of the valve seat surface, to thereby improve valve seat performance in resistance to leakage.

11 Claims, 3 Drawing Sheets

SPRINKLER HEAD HAVING PROTUBERANT RIDGE VALVE SEAT

The invention relates to fire protection sprinkler heads of the type employing a resiliently flexible valve disk.

Fire protection sprinkler heads having resiliently flexible valve components are known in the art. Those having flexible seat elements attached to the frame include Grinnell U.S. Pat. Nos. 431,971; 431,972 (FIGS. 1–4); and Job U.S. Pat. No. 3,253,657. Others describe sprinkler heads having a resiliently flexible valve disk disposed with its peripheral edge engaged upon the valve seat outwardly of the throat. Force applied to the central portion of the valve disk via temperature responsive means presses the valve disk periphery into sealing engagement upon the valve seat. Sprinkler heads of this type include Grinnell U.S. Pat. No. 431,972 (FIGS. 5–6); Martin U.S. Pat. No. 891,279 (disk 4); Job U.S. Pat. No. 4,167,974 and also Retzloff et al. U.S. Pat. No. 4,570,720 and U.S. Pat. No. 4,623,023.

SUMMARY OF THE INVENTION

According to the invention, a fire protection sprinkler head comprises a base adapted for connection to a source of fire retardant fluid under pressure, a throat in the base through which fire retardant fluid can flow, a valve seat defined by the base about the periphery of the throat, and a resiliently flexible valve disk disposed across the throat and impressed upon the valve seat in sealing engagement. The valve seat comprises an arcuate profile segment, with a protuberant ridge disposed about the periphery of the throat and adjacent thereto, defining a valve seat surface in the region of the crest of the protuberant ridge, and the valve seat further comprises a recessed surface segment disposed radially outwardly of the throat and of the protuberant ridge, the recessed surface being divergent from the plane of the crest of the protuberant ridge. The valve disk has a sealing surface adapted to be impressed upon the valve seat surface of the protuberant ridge in sealing engagement over an annular region inward of the peripheral edge of the valve disk.

Preferred embodiments of the invention may include one or more of the following features. The sprinkler head further comprises a frame having two or more frame arms extending outwardly from the base and joining in an arch-form at a position spaced from the throat, and temperature responsive means extending between the valve risk and frame arms to impress the valve disk in sealing engagement upon the valve seat surface, the valve seat surface being closely adjacent to the throat. The recessed surface of the valve seat is smoothly tapered outwardly from the region of the crest of the protuberant ridge, preferably at an uniform incline of predetermined angle, e.q. of the order of about 5°. The resiliently flexible valve disk comprises an annular disk spring, e.q., of generally truncated conical form or substantially flat, and it is preferred that the valve disk further comprises a gasket disposed between a bearing surface of the disk spring and the valve seat surface, made, e.q., of tetrafluoroethylene (TFE) or fluorinated ethylene propylene (FEP). The sprinkler head further comprises a rigid valve button adapted to apply the force to a central portion of the valve disk via the temperature responsive means thereby impress the valve disk upon the valve seat surface in sealing engagement.

Other features and advantages of the invention will be apparent from the following description of a presently preferred embodiment, and from the claims.

PREFERRED EMBODIMENT

We first briefly describe the drawings.

FIG. 1 is a perspective view of a fire protection sprinkler head of the invention, while

Figure 3:
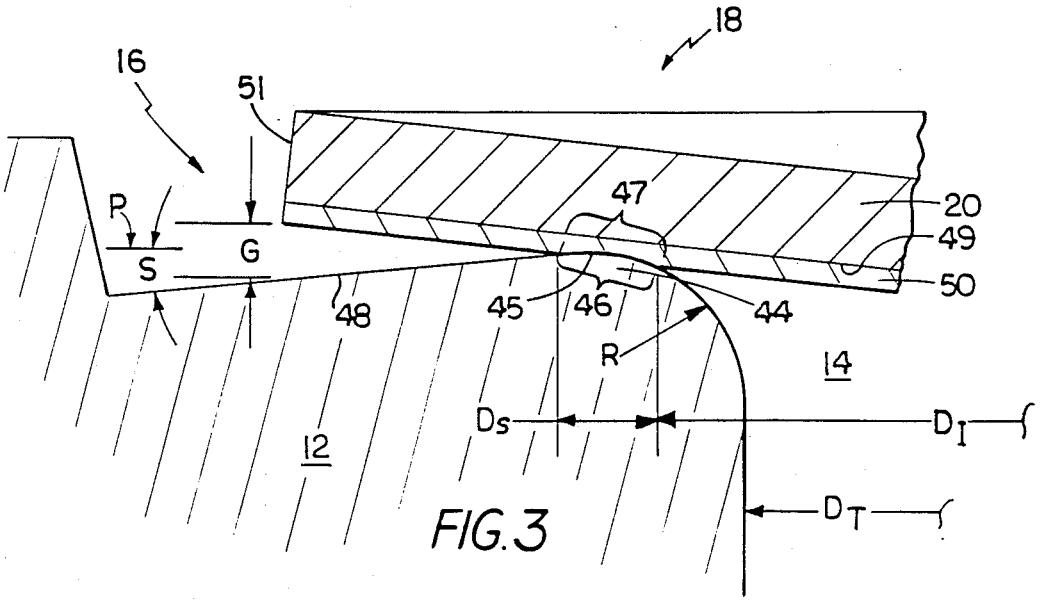
FIG. 3 is a similar view, taken on a much enlarged scale, of a portion of the valve seat of FIG. 2 with a resiliently flexible valve disk impressed sealingly thereupon.
Figure 4:
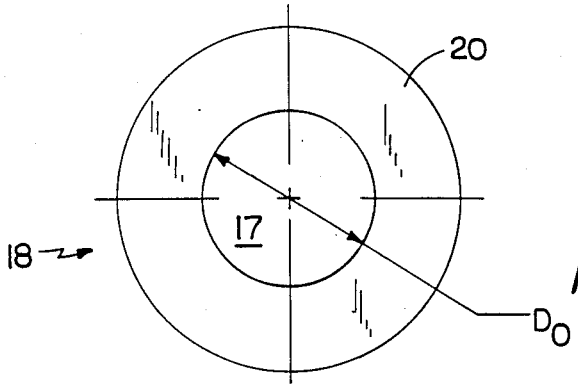
Figure 4A:
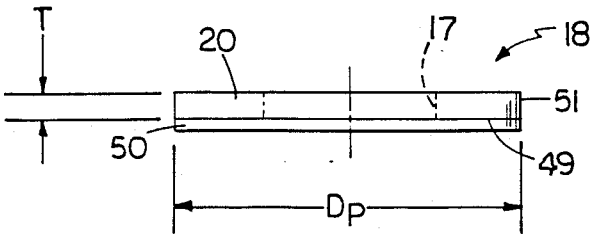
Figure 6:
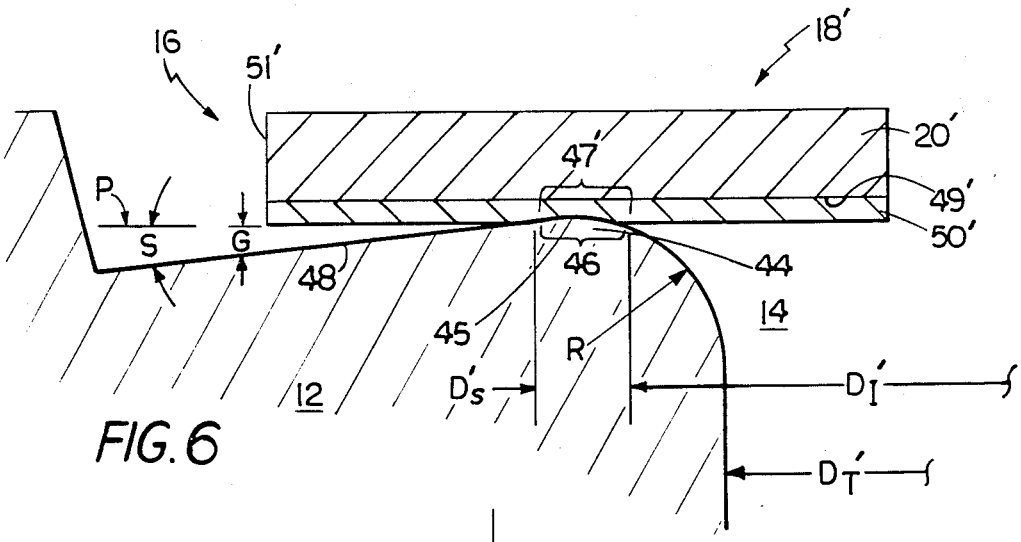
Figure 6A:
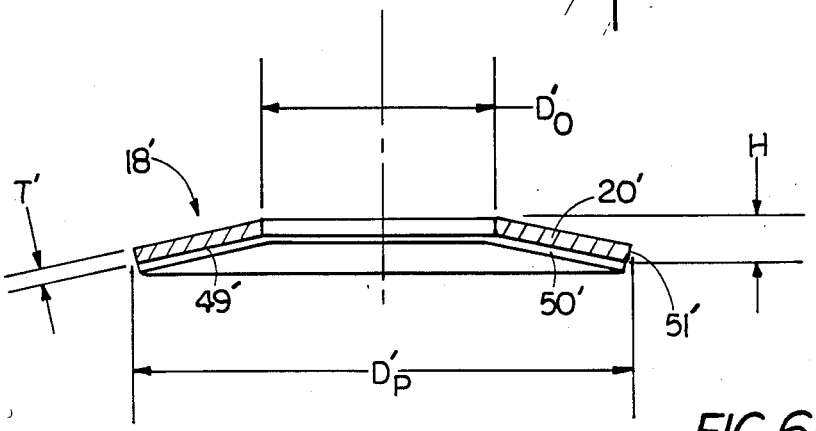
Figure 5:
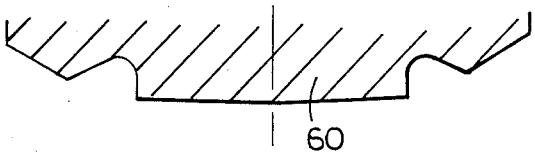

FIGS. 4 and 4*a* are plan and side views respectively of the resiliently flexible valve disk of FIG 3;

FIG. 5 is a side view of a seat cutter for forming the valve seat of the sprinkler head of the invention;

FIG. 6 is a view similar to FIG. 3 of a valve seat of the invention with another embodiment of a resiliently flexible valve disk impressed sealingly thereupon; and FIG. 6A is a side section view of the resiliently flexible valve disk of FIG. 6.

Figure 1:
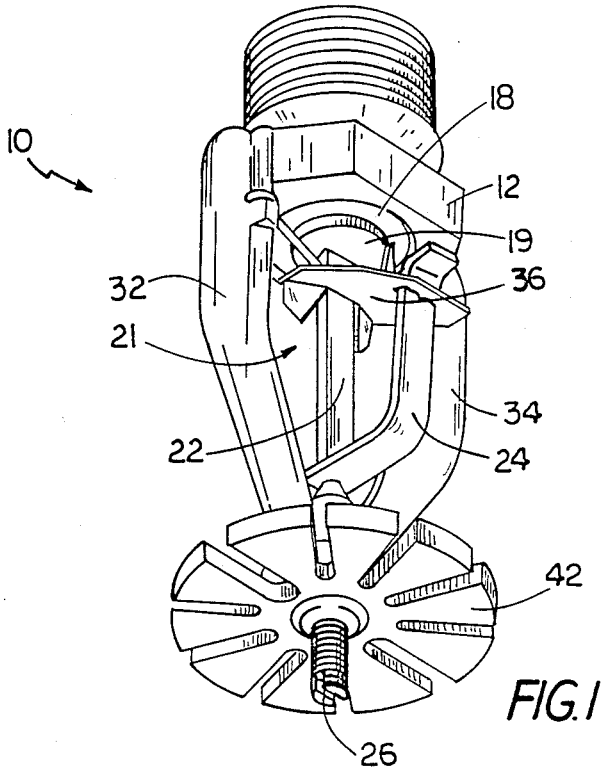
Figure 1A:
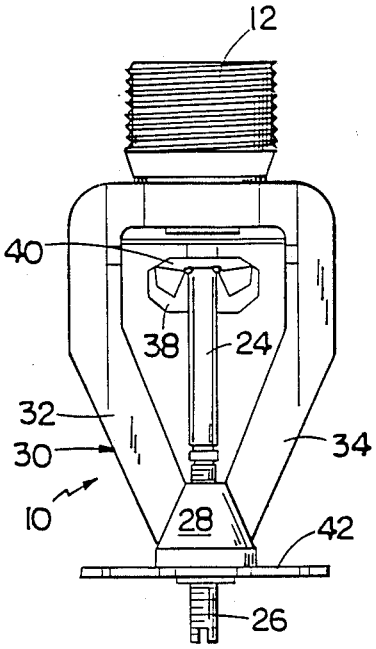
FIG. 1A is a face view and FIG. 1B is a side view partially in section of the sprinkler head of FIG. 1.
Figure 1B:
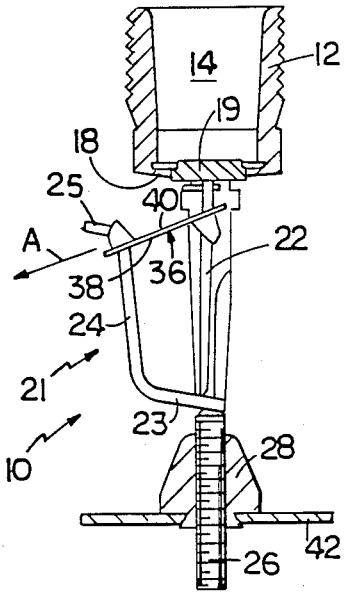

Referring to FIG. 1, a fire protection sprinkler head 10 of the invention has a base or frame 12 threaded for connection to a source of fire retardant fluid under pressure. The base defines a throat 14 (FIG. 1B) and a valve seat 16 (FIG. 2) about the periphery of the throat, discussed more fully below. A resiliently flexible valve disk 18, consisting in the preferred embodiment of a combination of a resiliently flexible flat annular disk spring 20 and gasket 50 (FIGS. 4 and 4A) is impressed sealingly upon the valve seat, as shown in FIG. 3. The valve disk is held in place by a temperature responsive assembly 21, which includes strut 22 and spring hook 24. The strut 22 extends between a rigid valve button 19 disposed within a central opening 17 in the resilient valve disk 18 and the inner end portion 23 of spring hook 24, adjacent adjustable compression screw 26, threaded through the apex 28 of an arch 30 formed by frame arms 32, 34. The assembly 21 further includes a fusible link 36, consisting of two thin metal plates 38, 40 held together by a fusible material, e.g. as described in U.S. patent application Ser. No. 162,694, filed Mar. 1, 1988, the relevant disclosure of which is incorporated herein by reference. The fusible link 36 extends between strut 22 and the outer end portion 25 of hook 24, which is spring biased (arrow A) in a manner to keep the elements 38, 40 of the fusible link under tension. A deflector 42 is mounted at the frame apex 28 to disperse flame retardant fluid, e.q. water, flowing from the throat.

Figure 2:
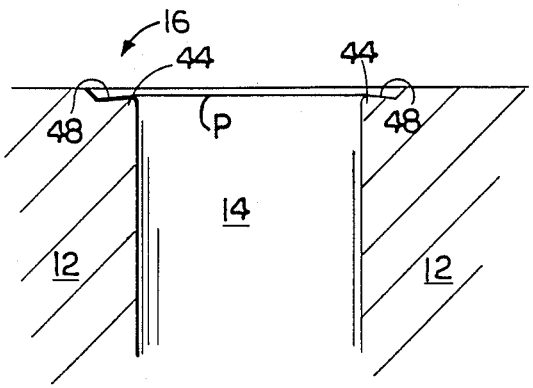
FIG. 2 is a side section view of the valve seat of the sprinkler head of the invention.

Referring to FIGS. 2 and 3, valve seat 16 defined by the base 12 about throat 14 has an arcuate profile segment, with a protuberant ridge 44 disposed about the periphery of the throat The protuberant ridge is closely adjacent to the throat and defines a valve seat surface 46 in the region of its crest 45. The valve seat further has a recessed surface 48 disposed radially outwardly of the throat and protuberant ridge. The recessed surface 48 diverges outwardly, away from a plane, P, of the crest of the protuberant ridge at a uniform incline of angle, S, e.g., nominally about 5°.

In FIG. 3, the valve seat 16 of the invention is shown with valve disk 18, including a disk spring 20 that is substantially flat in the unassembled state, as shown in FIGS. 4 and 4A, impressed in sealing engagement upon the valve seat surface 46 defined by the protuberant ridge 44, in the region of the crest 45. The disk spring 20 is formed of spring temper Inconel per ASTM B168 and, in the unassembled state, has outside diameter, $D_p$, nominally 0.562 inch; inside diameter, $D_o$, nominally 0.265 inch; and thickness, T, nominally 0.0225 inch, for the case of a nominal throat diameter, $D_T$, 0.4375 inch, and radius, R, nominally 0.010 inch. The bearing surface 49 of disk spring 20 is covered with a gasket 50, e.g., of fluorinated ethylene propylene (FEP) film, nominally 0.002 inch thick in the unassembled state (FIG. 4A). The gasket is impressed in the assembled condition (FIG 3) to about 0.001 inch thick between the opposed valve seat surface 46 and bearing surface 49, to form a leak-tight seal between gasket seat surface 47 and valve seat surface 46, with a radial width, $D_s$, nominally 0.013 inch. As seen in FIG. 3, the valve seat surface 46 is engaged by the gasket seat surface 47 at a point well inward of the peripheral edge 51 of the disk spring 20, and, in the assembled state (FIG. 3), the periphery of gasket 50 is spaced a distance, G, e.g., nominally about 0.006 inch in the embodiment shown, from the inclined recessed surface 48 of the valve seat, such that the periphery of the valve disk 18 is not held in sealing engagement with surface 48.

As pressure in the fire retardant fluid supply line fluctuates, as often happens, the resilient valve disk 18 is caused to flex slightly, and the frame arms 32, 34 will flex slightly as well. Due to the tapering away of recessed surface 48 of the valve seat 16, however, the annular region of sealing engagement of the gasket seat surface 47 upon valve seat surface 46 will not significantly change, remaining instead in the region of the crest of the protuberant ridge 44, and thus well inward of the periphery 51 of the disk spring 20. As a result, the effective inside diameter, $D_I$, of the sealing engagement at the valve seat surface remains at all times closely adjacent to the diameter, $D_T$ of the throat and the width of the valve seat surface, $D_S$, is minimized such that the performance of the sprinkler 10 of the invention in resistance to leakage past the valve seat surface, and separation of the valve disk from the valve seat surface, is improved over that of prior art sprinklers having resilient flexible valve disk components. This improved performance is also attributed to the fact that the area of valve seat surface 46 is less than that which would exist if the periphery of the disk spring 20 was held in sealing engagement with the valve seat surface as in prior art sprinklers such as taught by Job U.S. Pat. No. 4,167,974 and others. In the present embodiment, for the case of diameter, $D_T$, beinq nominally 0.4375 inch, and the other associated parameters being as described above, at an assembly load of about 108 pounds imposed on the rigid valve button 19, leakage past the valve seat surface and separation of the valve disk from the valve seat surface, i.e. "lift-off", have been found to occur at an average pressure about 40% higher in sprinklers employing the invention as compared to prior art sprinklers in which the periphery of the valve disk is held in sealing engagement with the valve seat.

In FIG. 5, there is shown a cutter 60 for forming the described valve seat of the invention.

Referring to FIGS. 6 and 6A , there is shown another embodiment of a sprinkler head of the invention, having a valve disk spring 18 of truncated conical ("Belleville") configuration. In FIG. 6A, the valve disk 18 is shown prior to assembly. The Belleville-type disk spring is formed of spring temper Inconel per ASTM B670 and, in the unassembled state, has an outside diameter, $D_P'$, nominally 0.783 inch; has inside diameter, $D_o'$, nominally 0.405 inch; a height, H, nominally 0.054 inch; and a thickness, T', nominally 0.0315 inch; for the case of nominal throat diameter, $D_T$, e.g. 0.700 inch. The bearing surface 49' of the disk spring 20' is covered with a gasket 50', e.g., of tetrafluroethylene (TFE) film, nominally 0.002 inch thick in the unassembled state. The gasket is impressed in the assembled condition (FIG. 6) to about 0.001 inch thickness between the opposed surfaces 46, 49' to form a leak tight seal between gasket seat surface 47' and valve seat surface 46 having a radial width, $D_s'$, nominally 0.016 inch. In the embodiment of FIGS. 6 and 6A, where $D_T'$ is 0.700 inch and the other associated parameters are as described above, at an assembly load of about 245 pounds imposed on the rigid valve button 19, leakage past the valve seat surface and separation of the valve disk from the valve seat surface ("lift off") have been found to occur at an average pressure about 15% higher in sprinklers of the invention as compared to prior art sprinkler designs in which the periphery of the valve disk is held in sealing engagement with valve seat.

These and other embodiments of the invention are within the following claims. For example, it is contemplated that there may be used any angle S which would result in the valve disk being impressed sealinqly upon a valve seat surface in the region of the crest of a protuberant ridge in an annular region of the gasket seat surface of the resilient valve disk inward of its periphery, such that the effective inside diameter of the sealing engagement on the valve seat surface remains at all times closely adjacent to the diameter of the throat and the width of the valve seat surface is minimized so that the resistance to leakage past the valve seat surface and separation of the valve disk from the valve seat surface is improved over that of prior art sprinklers having a resiliently flexible valve disk having its periphery held in sealing engagement with the valve seat.

We claim:

1. A fire protection sprinkler head comprising a base adapted for connection to a source of fire retardant fluid under pressure, a throat in said base having an exit orifice through which fire retardant fluid can flow, a valve seat defined by said base about the periphery of said throat exit orifice, and a resiliently flexible valve disk element disposed across said throat and impressed upon said valve seat in sealing engagement, said valve seat comprising an arcuate profile segment beginning at said throat exit orifice in said base, with a protuberant ridge disposed about the periphery of said throat and immediately adjacent thereto, defining a valve seat surface in the region of the crest of said protuberant ridge, and said valve seat further comprising a recessed surface segment disposed radially outwardly of said throat exit orifice and of said protuberant ridge, the recessed surface being divergent from said protuberant ridge, and said valve disk element comprising a disk spring having a sealing surface adapted to be impressed upon the valve seat surface of said protuberant ridge in sealing engagement over an annular region inward of the peripheral edge of said valve disk, said disk element maintaining sealing engagement in said region of said crest during flexing of said disk element, the diameter of sealing engagement of said seat surface remaining at all times closely adjacent to the diameter of the throat exit orifice.

2. The fire protection sprinkler head of claim 1 wherein said sprinkler head further comprises a frame having two or more frame arms, said frame arms extending outwardly from said base and joining in an arch-form at a position spaced from throat, and temperature responsive means extending between said valve disk and said frame arms to impress said valve disk in sealing engagement upon said valve seat surface.

3. The fire protection sprinkler head of claim 1 wherein the valve seat surface of said protuberant ridge is closely adjacent to said throat.

4. The fire protection sprinkler head of claim 1 wherein the recessed surface of said valve seat is smoothly tapered outwardly from the region of the crest of said protuberant ridge.

5. The fire protection sprinkler head of claim 4 wherein said recessed surface is tapered at an uniform incline of predetermined angle.

6. The fire protection sprinkler head of claim 5 wherein said predetermined angle is of the order of about 5°.

7. The fire protection sprinkler head of claim 1 wherein said disk spring is of a generally truncated conical form.

8. The fire protection sprinkler head of claim 1 wherein said resiliently flexible valve disk comprises a substantially flat disk spring.

9. The fire protection sprinkler head of claim 7, 8 or 9 wherein said resiliently flexible valve disk further comprises a gasket means disposed between a bearing surface of said disk spring and said valve seat surface.

10. The fire protection sprinkler head of claim 9 wherein said gasket means is film of tetrafluoroethylene (TFE) or fluorinated ethylene propylene (FEP).

11. The fire protection sprinkler head of claim 1 or 3 further comprising a rigid valve button adapted to apply said force to a central portion of said valve disk via said temperature, responsive means, thereby to impress said valve disk upon said valve seat surface in sealing engagement.

* * * * *

UNITED STATES PATENT AND TRADEMARK OFFICE

CERTIFICATE OF CORRECTION

PATENT NO. : 4,901,799

DATED : February 20, 1990

INVENTOR(S) : Jerome S. Pepi et al.

It is certified that error appears in the above-identified patent and that said Letters Patent is hereby corrected as shown below:

Col. 6, claim 9, lines 13-14, replace "7, 8 or 9" with --7 or 8--,

Signed and Sealed this

Ninth Day of June, 1992

*Attest:*

DOUGLAS B. COMER

*Attesting Officer*

*Acting Commissioner of Patents and Trademarks*